US008995896B2

(12) United States Patent
Amano et al.

(10) Patent No.: US 8,995,896 B2
(45) Date of Patent: Mar. 31, 2015

(54) FIXING DEVICE AND IMAGE FORMING APPARATUS

(71) Applicant: Fuji Xerox Co., Ltd., Tokyo (JP)

(72) Inventors: Junpei Amano, Kanagawa (JP); Norimasa Fujiwara, Kanagawa (JP); Satoshi Nakamura, Kanagawa (JP); Atsumi Kurita, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/972,387

(22) Filed: Aug. 21, 2013

(65) Prior Publication Data

US 2014/0270870 A1 Sep. 18, 2014

(30) Foreign Application Priority Data

Mar. 18, 2013 (JP) ..... 2013-054808

(51) Int. Cl.
*G03G 15/20* (2006.01)

(52) U.S. Cl.
CPC .... *G03G 15/2064* (2013.01); *G03G 2215/2022* (2013.01)
USPC ..... 399/329

(58) Field of Classification Search
CPC ..... G03G 15/2064
USPC ..... 399/329
See application file for complete search history.

(56) References Cited

U.S. PATENT DOCUMENTS

| | | | | |
|---|---|---|---|---|
| 5,499,087 | A * | 3/1996 | Hiraoka et al. | 399/329 |
| 5,964,339 | A * | 10/1999 | Matsuura et al. | 198/810.03 |
| 7,171,150 | B2 * | 1/2007 | Yonekawa | 399/329 |
| 8,498,561 | B2 * | 7/2013 | Yamaguchi et al. | 399/329 |
| 2011/0256479 | A1 * | 10/2011 | Ueda et al. | 430/124.3 |
| 2012/0093546 | A1 * | 4/2012 | Ohara et al. | 399/329 |
| 2013/0251419 | A1 * | 9/2013 | Kimura et al. | 399/329 |
| 2013/0272757 | A1 * | 10/2013 | Amano et al. | 399/329 |

FOREIGN PATENT DOCUMENTS

| | | |
|---|---|---|
| JP | A-2004-264398 | 9/2004 |
| JP | A-2008-064925 | 3/2008 |

* cited by examiner

*Primary Examiner* — W B Perkey
(74) *Attorney, Agent, or Firm* — Oliff PLC

(57) ABSTRACT

A fixing device includes: an endless belt member; a secured member disposed to contact the belt member; a support roller that rotatably supports the belt member; a heating unit that heats the belt member; and a rotary pressurizing roller that includes an elastic surface layer that is elastically deformed when the belt member is pressed against the secured member to form a fixing part. The secured member includes a recessed part provided on a surface of the secured member that faces the pressurizing roller and configured to curve the belt member into a recessed shape, projecting parts provided upstream and downstream of the recessed part, respectively, and configured to curve the belt member into a projected shape, and a region provided between at least one of the projecting parts and the recessed part and having a small curvature compared to the corresponding projecting part.

6 Claims, 7 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2013-054808 filed Mar. 18, 2013.

BACKGROUND

Technical Field

The present invention relates to a fixing device and an image forming apparatus.

SUMMARY

According to an aspect of the present invention, there is provided a fixing device including: an endless belt member; a secured member disposed in a secured state to contact an inner peripheral surface of the belt member; a support roller that rotatably supports the belt member; a heating unit that heats the belt member; and a rotary pressurizing roller that includes an elastic surface layer that is elastically deformed when the belt member is pressed against the secured member to form a fixing part, in which the secured member includes a recessed part provided on a surface of the secured member that faces the pressurizing roller and configured to curve the belt member along the secured member into a recessed shape in which the belt member is recessed from the pressurizing roller toward the secured member, projecting parts provided upstream and downstream of the recessed part, respectively, along a moving direction of the belt member and configured to curve the belt member into a projected shape in which the belt member is projected toward the pressurizing roller, and a region provided between at least one of the projecting parts provided upstream and downstream of the recessed part and the recessed part, the region having a small curvature compared to the corresponding projecting part.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the drawings.

[First Exemplary Embodiment]

Figure 1:
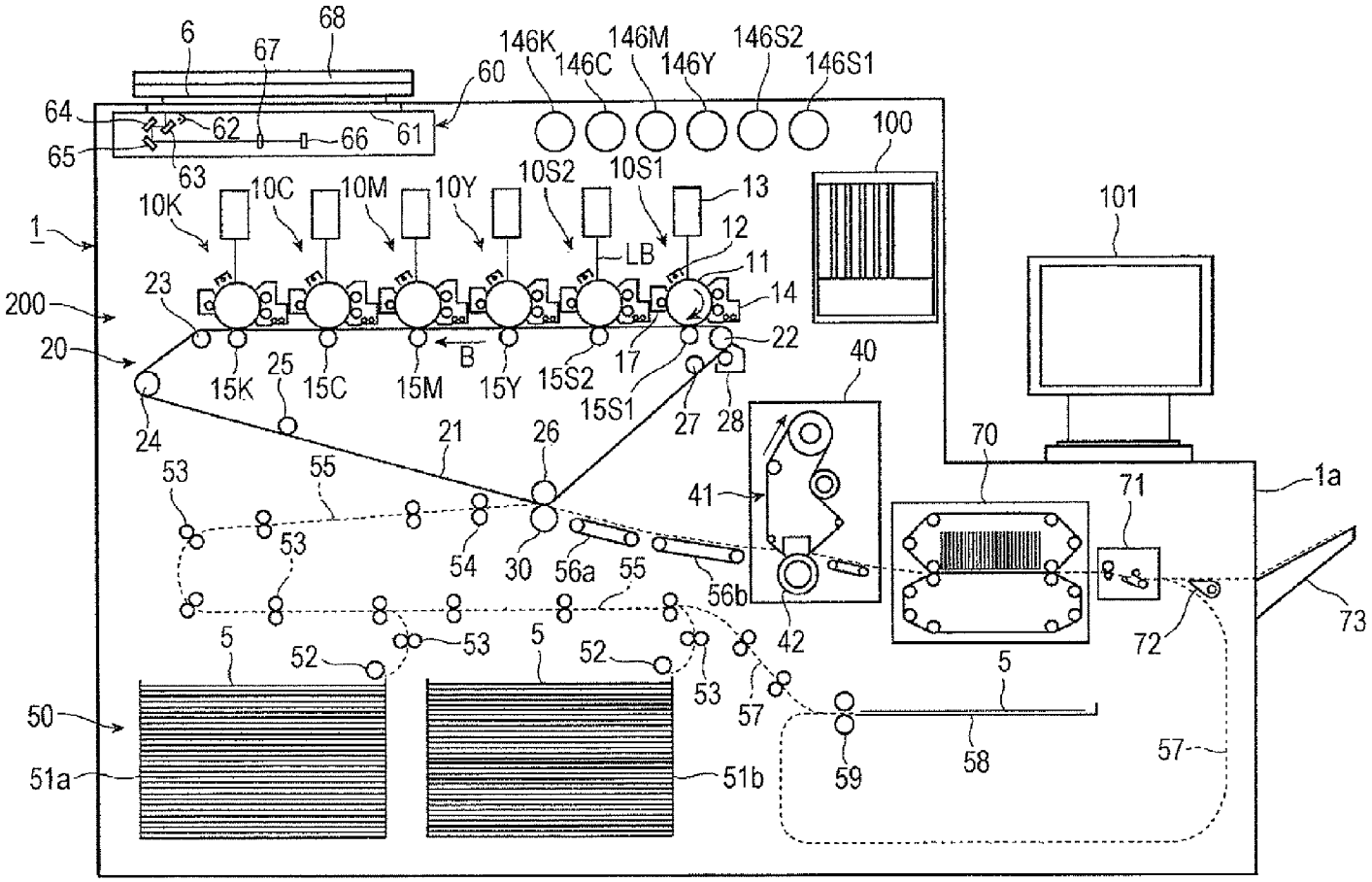
FIG. 1 shows a schematic configuration of an image forming apparatus including a fixing device according to a first exemplary embodiment of the present invention.
Figure 2:
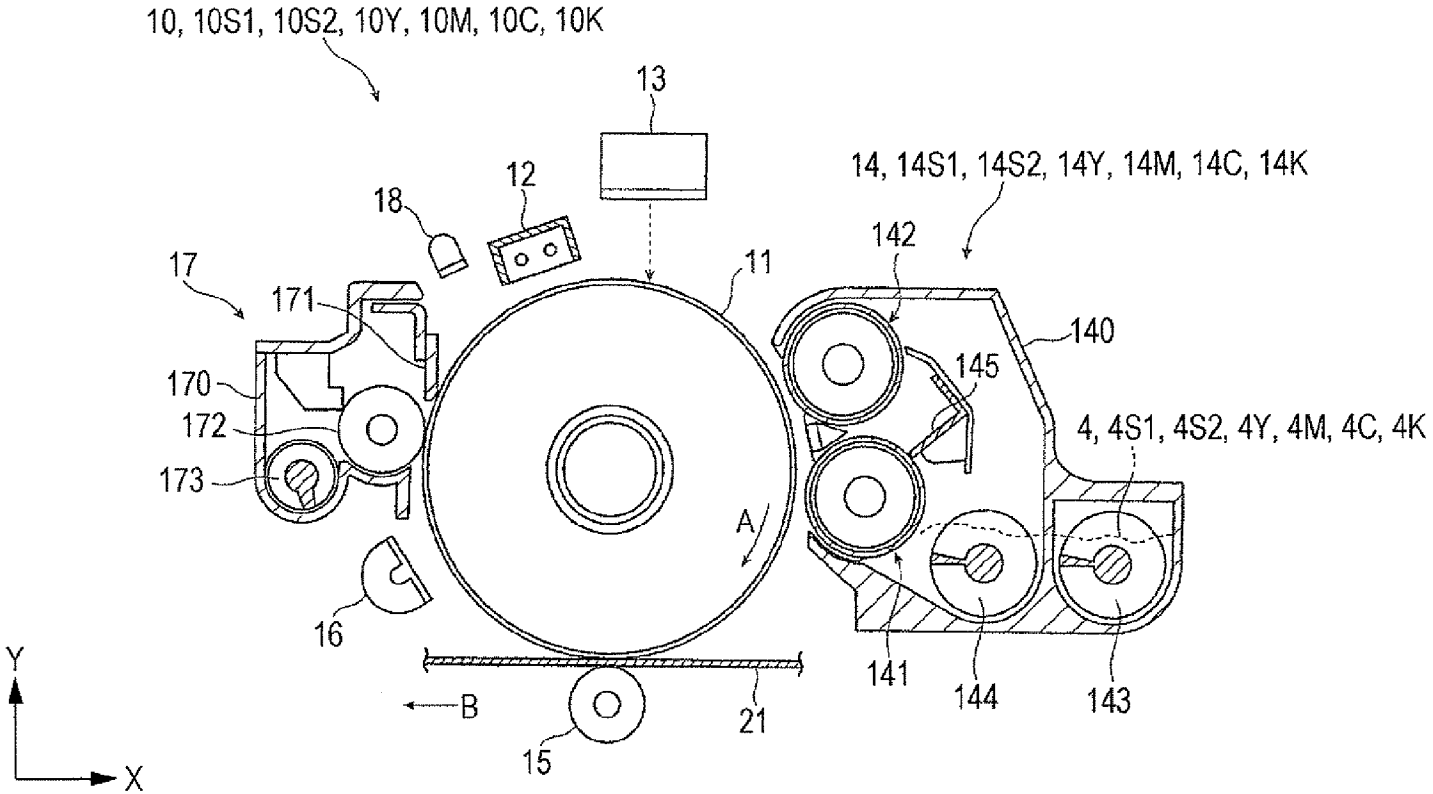
FIG. 2 shows the configuration of an image preparing device of the image forming apparatus according to the first exemplary embodiment of the present invention.

FIGS. 1 and 2 show an image forming apparatus including a fixing device according to a first exemplary embodiment. FIG. 1 shows the overview of the entire image forming apparatus. FIG. 2 shows a portion of the image forming apparatus (such as an image preparing device) as enlarged.

<Overall Configuration of Image Forming Apparatus>

An image forming apparatus 1 according to the first exemplary embodiment is configurated as a color printer, for example. The image forming apparatus 1 includes an image forming section 200 that serves as an example of an image forming unit that forms an image on a recording material on the basis of image data. The image forming section 200 of the image forming apparatus 1 includes plural image preparing devices 10, an intermediate transfer device 20, a paper feed device 50, a fixing device 40, and so forth. The image preparing devices 10 form a toner image to be developed using a toner that serves as a developer. The intermediate transfer device 20 holds the toner images formed by the image preparing devices 10 to transport the toner images finally to a second transfer position at which the toner images are subjected to a second transfer performed onto recording paper 5 that serves as an example of the recording material. The paper feed device 50 stores and transports the prescribed recording paper 5 to be supplied to the second transfer position of the intermediate transfer device 20. The fixing device 40 fixes the toner images on the recording paper 5 which have been subjected to the second transfer performed by the intermediate transfer device 20.

In the case where the image forming apparatus 1 is additionally equipped with an image input device 60 that allows input of a document image to be formed on the recording paper 5, for example, the image forming apparatus 1 may be configurated as a color copier. In FIG. 1, reference symbol 1*a* denotes a housing of the image forming apparatus. The housing 1*a* is formed from a support structure member, an outer covering, and so forth. The broken lines in FIG. 1 indicate principal transport paths along which the recording paper 5 is transported in the housing 1*a*.

The image preparing devices 10 are composed of six image preparing devices 10Y, 10M, 10C, 10K, 10S1, and 10S2 that exclusively form toner images in four colors, namely yellow (Y), magenta (M), cyan (C), and black (K) and toner images in two special colors S1 and S2, respectively. The six image preparing devices 10 (S1, S2, Y, M, C, K) are disposed side by side in a line in the internal space of the housing 1*a*. Examples of developers 4 (S1, S2) for the special colors (S1, S2) include color materials etc. that are difficult or impossible to express using the four colors. Specific examples include a toner in a color different from the four colors, a toner in the same color as the four colors but with a different saturation, a transparent toner that provides an improved gloss, an expandable toner for Braille printing, and a toner in a fluorescent color. The image preparing devices 10 (S1, S2, Y, M, C, K) have substantially common configurations as described below except that the image preparing devices 10 use different types of developers.

As shown in FIGS. 1 and 2, the image preparing devices 10 (S1, S2, Y, M, C, K) each include a photosensitive drum 11 that serves as an example of a rotary image holding member. The following various devices are principally disposed around the photosensitive drum 11. The devices include a charging device 12, an exposure device 13, a developing device 14 (S1, S2, Y, M, C, K), a first transfer device 15, a pre-cleaning charging device 16, a drum cleaning device 17, a static eliminator 18, and so forth. The charging device 12 charges a peripheral surface (image holding surface) of the photosensitive drum 11, on which an image may be formed, with a prescribed potential. The exposure device 13 serves as an electrostatic latent image forming unit that radiates light LB based on information (signal) on an image to the charged peripheral surface of the photosensitive drum 11 to form an electrostatic latent image (for each color) with a potential difference. The developing device 14 (S1, S2, Y, M, C, K) serves as a developing unit that develops the electrostatic latent image using a toner of the developer 4 for the corresponding color (S1, S2, Y, M, C, K) to form a toner image. The first transfer device 15 transfers the toner image to the intermediate transfer device 20. The pre-cleaning charging device 16 charges attached matter such as a toner remaining on and adhering to the image holding surface of the photosensitive drum 11 after the first transfer. The drum cleaning device 17 removes the recharged attached matter. The static eliminator 18 eliminates static from the image holding surface after the photosensitive drum 11 is cleaned.

The photosensitive drum 11 has an image holding surface formed by providing a photoconductive layer (photosensitive layer) made of a photosensitive material on the peripheral surface of a grounded cylindrical or columnar base material. The photosensitive drum 11 is supported so as to receive power from a rotary drive device (not shown) to rotate in the direction indicated by the arrow A.

The charging device 12 is configurated as a non-contact charging device, such as a corona discharger, disposed without contact with the photosensitive drum 11. A charging voltage is supplied to the charging device 12. In the case where the developing device 14 performs reversal development, a voltage or a current having the same polarity as the polarity for charging the toner supplied from the developing device 14 is supplied as the charging voltage.

The exposure device 13 radiates the light LB, formed in accordance with the information on the image input to the image forming apparatus 1, toward the peripheral surface of the photosensitive drum 11 after being charged to form an electrostatic latent image. When a latent image is to be formed, information (signal) on the image input in any manner to the image forming apparatus 1 is transmitted to the exposure device 13.

As shown in FIG. 2, the developing devices 14 (S1, S2, Y, M, C, K) each include a housing 140, two developing rollers 141 and 142, two agitation/transport members 143 and 144, a layer thickness restricting member 145, and so forth. The housing 140 includes an opening portion and a storing chamber for the developer 4, and houses the other components. The developing rollers 141 and 142 hold the developer 4, and transport the developer 4 to two development regions facing the photosensitive drum 11. The agitation/transport members 143 and 144, which may be screw augers, transport the developer 4 to cause the developer 4 to pass through the developing roller 142 while agitating the developer 4. The layer thickness restricting member 145 restricts the amount (layer thickness) of the developer held by the developing roller 142. A development voltage from a power source device (not shown) is supplied between the developing rollers 141 and 142 of the developing device 14 and the photosensitive drum 11. Power from a rotary drive device (not shown) is transmitted to the developing rollers 141 and 142 and the agitation/transport members 143 and 144 to rotate the developing rollers 141 and 142 and the agitation/transport members 143 and 144 in a prescribed direction. Further, a two-part developer containing a non-magnetic toner and a magnetic carrier is used as the developers 4 (Y, M, C, K) for the four colors. In FIG. 1, reference numeral 146 (S1, S2, Y, M, C, K) denotes a developer storing container that stores a developer containing at least a toner to be supplied to the corresponding developing device 14 (S1, S2, Y, M, C, K).

The first transfer device 15 is a contact transfer device including a first transfer roller that rotates in contact with the peripheral surface of the photosensitive drum 11 and that is supplied with a first transfer voltage. A DC voltage having a polarity opposite to the polarity for charging the toner is supplied from a power source device (not shown) as the first transfer voltage.

As shown in FIG. 2, the drum cleaning device 17 includes a body 170, a cleaning plate 171, a rotary brush roller 172, a feeding member 173, and so forth. The body 170 has the shape of a partially open container. The cleaning plate 171 is disposed so as to contact the peripheral surface of the photosensitive drum 11, after being subjected to the first transfer, with a prescribed pressure to clean the photosensitive drum 11 by removing attached matter such as a residual toner. The rotary brush roller 172 is disposed upstream of the cleaning plate 171 in the rotational direction of the photosensitive drum 11 to rotate in contact with the peripheral surface of the photosensitive drum 11. The feeding member 173, which may be a screw auger, recovers attached matter, such as a toner, removed by the cleaning plate 171 to feed the attached matter to a recovery system (not shown). A plate-like member (for example, blade) made of a material such as rubber is used as the cleaning plate 171.

As shown in FIG. 1, the intermediate transfer device 20 is disposed at a position below the image preparing devices 10 (S1, S2, Y, M, C, K). The intermediate transfer device 20 is principally composed of an intermediate transfer belt 21, plural belt support rollers 22 to 27, a second transfer device 30, and a belt cleaning device 28. The intermediate transfer belt 21 rotates in the direction indicated by the arrow B while passing through first transfer positions between the photosensitive drum 11 and the first transfer devices 15 (first transfer rollers). The belt support rollers 22 to 27 rotatably support the intermediate transfer belt 21 by holding the intermediate transfer belt 21 in a desired state from the inner side. The second transfer device 30 is disposed on the side of the outer peripheral surface (image holding surface) of the intermediate transfer belt 21 supported by the belt support roller 26 to have the toner image on the intermediate transfer belt 21 subjected to a second transfer performed onto the recording paper 5. The belt cleaning device 28 cleans the intermediate transfer belt 21 by removing attached matter such as a toner and paper powder remaining on and adhering to the outer peripheral surface of the intermediate transfer belt 21 after passing through the second transfer device 30.

An endless belt fabricated from a material obtained by dispersing a resistance adjusting agent such as carbon black etc. in a synthetic resin such as a polyimide resin or a polyamide resin, for example, is used as the intermediate transfer belt 21. The belt support roller 22 is configurated as a driving roller. The belt support rollers 23, 25, and 27 are each configurated as a driven roller that maintains the travel position etc. of the intermediate transfer belt 21. The belt support roller 24 is configurated as a tension applying roller. The belt support roller 26 is configurated as a second transfer back-up roller.

As shown in FIG. 1, the second transfer device 30 is a contact transfer device including a second transfer roller provided at the second transfer position, which is a portion of the outer peripheral surface of the intermediate transfer belt 21 supported by the belt support roller 26 in the intermediate transfer device 20. The second transfer roller rotates in contact with the peripheral surface of the intermediate transfer belt 21, and is supplied with a second transfer voltage. A DC voltage having a polarity opposite to or the same as the polarity for charging the toner is supplied as the second transfer voltage to the second transfer device 30 or the support roller 26 of the intermediate transfer device 20.

The fixing device 40 includes a heating rotary member 41, a pressurizing rotary member 42, and so forth. The heating rotary member 41 includes a fixing belt that rotates in the direction indicated by the arrow and that is heated by a heating unit such that the surface temperature is maintained at a predefined temperature. The pressurizing rotary member 42, which may be in a roller form, rotates in contact with the heating rotary member 41 at a prescribed pressure. In the fixing device 40, a contact portion at which the heating rotary member 41 and the pressurizing rotary member 42 contact each other serves as a fixation processing part at which a prescribed fixation process (heating and pressurization) is performed. The fixing device 40 will be discussed in detail later.

The paper feed device 50 is disposed at a position below the intermediate transfer device 20 and the second transfer device 30. The paper feed device 50 is principally composed of one or more paper storing members 51*a* and 51*b* and feeding devices 52. The paper storing members 51*a* and 51*b* store a stack of sheets of the recording paper 5 of desired size, type, etc. The feeding devices 52 feed the recording paper 5, one sheet at a time, from the paper storing members 51*a* and 51*b*. The paper storing members 51*a* and 51*b* are attached so as to be drawn out toward the side of the front surface (a side surface that the user faces during operation) of the housing 1*a*, for example.

A paper feed/transport path 55 is provided between the paper feed device 50 and the second transfer device 30. The paper feed/transport path 55 is composed of plural pairs of paper transport rollers 53 and 54 and a transport guide member (not shown). The paper transport rollers 53 and 54 transport the recording paper 5 fed from the paper feed device 50 to the second transfer position. The pair of paper transport rollers 54 disposed at a position immediately before the second transfer position in the paper feed/transport path 55 are configurated as rollers (resist rollers) that adjust the transport timing for the recording paper 5, for example. Two paper transport devices 56*a* and 56*b* are provided between the second transfer device 30 and the fixing device 40. The paper transport devices 56*a* and 56*b*, which may be in the form of a belt or the like, transport the recording paper 5 after being subjected to the second transfer fed from the second transfer device 30 to the fixing device 40. A cooling unit 70, a curl correcting unit 71, and a switching member 72 are disposed downstream of the fixing device 40 along the paper transport direction. The cooling unit 70 cools the recording paper 5 which has been subjected to the fixation process. The curl correcting unit 71 corrects a curve (curl) of the recording paper 5. The switching member 72 switches the transport direction of the recording paper 5 between a paper ejection section 73 and a double-sided-printing transport path 57.

The double-sided-printing transport path 57 includes an intermediate storing container 58 that temporarily stores the recording paper 5, on one surface (first surface) of which an image has been formed. The intermediate storing container 58 is provided with feeding rollers 59 that feed the stored recording paper 5 with the front and back sides of the recording paper 5 reversed. The feeding side of the intermediate storing container 58 is connected to the paper feed/transport path 55 via a downstream region of the double-sided-printing transport path 57.

The image input device 60, which is provided in the case where the image forming apparatus 1 is configurated as a color copier as discussed earlier, is an image reading device that reads an image in a document carrying image information to be printed, and is disposed at the upper portion of the housing 1*a* as shown in FIG. 1, for example. The image input device 60 is principally composed of a document placing plate (platen glass) 61, a light source 62, a reflective mirror 63, a first reflective mirror 64, a second reflective mirror 65, an image reading element 66, an imaging lens 67, and so forth. The document placing plate 61 is a transparent glass plate or the like for placement of a document 6 carrying information on an image to be read. The light source 62 illuminates the document 6 placed on the document placing plate 61 while moving. The reflective mirror 63 receives light reflected from the document 6 to reflect the light in a predetermined direction while moving together with the light source 62. The first reflective mirror 64 and the second reflective mirror 65 move with respect to the reflective mirror 63 at a predetermined speed over a predetermined distance. The image reading element 66 is a CCD or the like that receives and reads light reflected from the document 6 to convert the light into an electric signal. The imaging lens 67 forms an image on the image reading element 66 on the basis of the reflected light. In FIG. 1, reference numeral 68 denotes an open/close covering that covers the document placing plate 61.

The image information on the document read and input through the image input device 60 is subjected to necessary image processing performed by an image processing device configurated as a part of a controller 100. First, the image input device 60 transmits image information on a read document to the image processing device 100 as image data (for example, data with 8 bits for each color) for three colors, namely red (R), green (G), and blue (B), for example. Meanwhile, the image processing device 100 performs predefined image processing on the image data transmitted from the image input device 60. Examples of the image processing include a shading correction, a misregistration correction, a lightness/color space conversion, a gamma correction, unframing, and color/movement editing. In addition, the image processing device 100 changes the image signals which have been subjected to the image processing into image signals for the four colors (Y, M, C, K), and thereafter transmits the resulting image signals to the exposure device 13. The image processing device 70 also generates image signals for the two special colors (S1, S2).

<Basic Operation of Image Forming Apparatus>

Basic image forming operation performed by the image forming apparatus 1 will be described below.

First, image forming operation for forming a full-color image by combining toner images in four colors (Y, M, C, K) using the four image preparing devices 10 (Y, M, C, K) will be described as a representative example.

When the image forming apparatus 1 receives command information requesting image forming operation (printing), the four image preparing devices 10 (Y, M, C, K), the intermediate transfer device 20, the second transfer device 30, the fixing device 40, and so forth are started.

In each of the image preparing devices 10 (Y, M, C, K), first, the photosensitive drum 11 rotates in the direction indicated by the arrow A, and the charging device 12 charges the surface of the photosensitive drum 11 with a prescribed polarity (in the first exemplary embodiment, negative polarity) and a predefined potential. Then, the exposure device 13 radiates the surface of the photosensitive drum 11 after being charged with light LB emitted on the basis of a signal for an image obtained by converting information on an image input to the image forming apparatus 1 into each color component (Y, M, C, K). Thus, an electrostatic latent image for each color component with a prescribed potential difference is formed on the surface of the photosensitive drum 11.

Then, the developing device 14 (Y, M, C, K) develops the electrostatic latent image for each color component formed on the photosensitive drum 11 by supplying a toner for the corresponding color (Y, M, C, K) charged with a prescribed polarity (negative polarity) for electrostatic adhesion. As a result of the development, the electrostatic latent images for the various color components formed on the photosensitive drums 11 are rendered manifest as toner images for the four colors (Y, M, C, K) developed using toners for the corresponding colors.

Then, when the toner image in each color formed on the photosensitive drum 11 of the image preparing device 10 (Y, M, C, K) is transported to the first transfer position, the first transfer device 15 performs a first transfer on the toner image in each color such that the toner images in the various colors are sequentially superposed on the intermediate transfer belt 21 of the intermediate transfer device 20 which rotates in the direction indicated by the arrow B.

In the image preparing device 10 which has finished the first transfer, the pre-cleaning charging device 16 recharges attached matter such as a toner remaining on the surface of the photosensitive drum 11 after the first transfer. After that, the drum cleaning device 17 cleans the surface of the photosensitive drum 11 by scraping off the recharged attached matter. Lastly, the static eliminator 18 eliminates static from the surface of the photosensitive drum 11 after being cleaned. This allows the image preparing device 10 to be ready for the next image preparing operation.

Then, the intermediate transfer device 20 transports the toner images which have been subjected to the first transfer to the second transfer position through rotation of the intermediate transfer belt 21. Meanwhile, the paper feed device 50 feeds the prescribed recording paper 5 to the paper feed/transport path 55 in accordance with the image preparing operation. In the paper feed/transport path 55, the pair of paper transport rollers 54 that serve as resist rollers feed the recording paper 5 to the second transfer position in accordance with the transfer timing to supply the recording paper 5.

At the second transfer position, the second transfer device 30 collectively performs a second transfer of the toner images on the intermediate transfer belt 21 onto the recording paper 5. In the intermediate transfer device 20 which has finished the second transfer, the belt cleaning device 28 removes attached matter such as a toner remaining on the surface of the intermediate transfer belt 21 after the second transfer.

Then, the recording paper 5, onto which the toner images have been transferred through the second transfer, is peeled from the intermediate transfer belt 21 and the second transfer device 30, and thereafter transported to the fixing device 40 by the transport devices 56*a* and 56*b*. The fixing device 40 performs a necessary fixation process (heating and pressurization) to fix unfixed toner images to the paper 5 as discussed later. Lastly, the cooling unit 70 cools the recording paper 5 which has been subjected to the fixation by absorbing heat from the recording paper 5 and the toner images. After that, the curl correcting unit 71 corrects curl of the recording paper 5. In the case of image forming operation in which an image is to be formed on only one surface of the recording paper 5, the recording paper 5 is ejected to the paper ejection section 73 provided outside the housing 1*a*, for example, by a pair of paper ejection rollers (not shown) via the switching member 72.

In the case of image forming operation in which an image is to be formed on both surfaces of the recording paper 5, meanwhile, the switching member 72 switches the transport direction of the recording paper 5 for which curl has been corrected to the double-sided-printing transport path 57, and the recording paper 5 is temporarily stored in the intermediate storing container 58 via the double-sided-printing transport path 57. The recording paper 5 stored in the intermediate storing container 58 is fed to the paper feed/transport path 55 by the feeding rollers 59 via the double-sided-printing transport path 57 with the front and back sides of the recording paper 5 reversed. In the paper feed/transport path 55, the pair of paper transport rollers 57 which serve as resist rollers feed the recording paper 5 to the second transfer position in accordance with the transfer timing to supply the recording paper 5. This allows toner images to be transferred to the back surface (second surface) of the recording paper 5 through the second transfer.

After that, similar to the image forming operation in which an image is to be formed on only one surface of the recording paper 5, the recording paper 5, on the back surface of which the toner images have been transferred through the second transfer, is transported to the fixing device 40 by the transport devices 56*a* and 56*b* to be subjected to a fixation process. After that, the cooling unit 70 cools the recording paper 5 and the toner images, and the curl correcting unit 71 corrects curl of the recording paper 5. The recording paper 5 is ejected to the paper ejection section 73 via the switching member 72.

As a result of the operation described above, the recording paper 5 is output with a full-color image formed thereon by combining the toner images in the four colors.

Next, operation of the image forming apparatus 1 for a case where special-color toner images are formed using developers for the special colors S1 and S2 together with a normal image formed as described above, for example, will be described.

In this case, first, the image preparing devices 10S1 and 10S2 perform image preparing operation similar to that performed by the image preparing devices 10 (Y, M, C, K) discussed earlier. This allows the special-color toner images (S1, S2) to be formed on the respective photosensitive drums 11 of the image preparing devices 10S1 and 10S2. Then, as in the image forming operation for the toner images in the four colors discussed earlier, the special-color toner images formed by the image preparing devices 10S1 and 10S2 are transferred to the intermediate transfer belt 21 of the intermediate transfer device 20 through the first transfer, and thereafter transferred from the intermediate transfer belt 21 to the recording paper 5 through the second transfer performed by the second transfer device 30 (together with the toner images in the other colors). Lastly, the recording paper 5, on which the special-color toner images and the toner images in the other colors have been transferred through the second transfer, is subjected to a fixation process performed by the fixing device 40, and thereafter ejected to the outside of the housing 1*a*.

As a result of the operation described above, the recording paper 5 is output with two special-color toner images superposed on the entirety or a part of the full-color image formed on the recording paper 5 by combining the toner images in the four colors discussed earlier.

Besides, in the case where the image forming apparatus 1 is a color copier equipped with the image input device 60, the basic image forming operation is performed as follows.

In this case, a document 6 is set on the image input device 60. When command information requesting image forming operation (copying) is received, the image input device 60 reads a document image from the document 6. After that, the image processing device 100 performs image processing on information on the read document image as discussed earlier to generate an image signal. After that, the image signal is transmitted to the exposure device 13 in each image preparing device 10 (S1, S2, Y, M, C, K). This causes each image preparing device 10 to form an electrostatic latent image and a toner image on the basis of the information on the image from the document 6. After that, operation similar to that in the case of the image forming operation (printing) discussed earlier is performed. Finally, an image formed from the toner images is formed on the recording paper 5 to be output.

In FIG. 1, reference numeral 101 denotes a user interface that allows a user to input image formation conditions etc.

The image forming apparatus 1 may be configurated to transfer the toner images formed by the image preparing devices 10 (S1, S2, Y, M, C, K) directly onto the recording paper 5, not via the intermediate transfer belt 21 of the intermediate transfer device 20.

<Configuration of Fixing Device>

Figure 3:
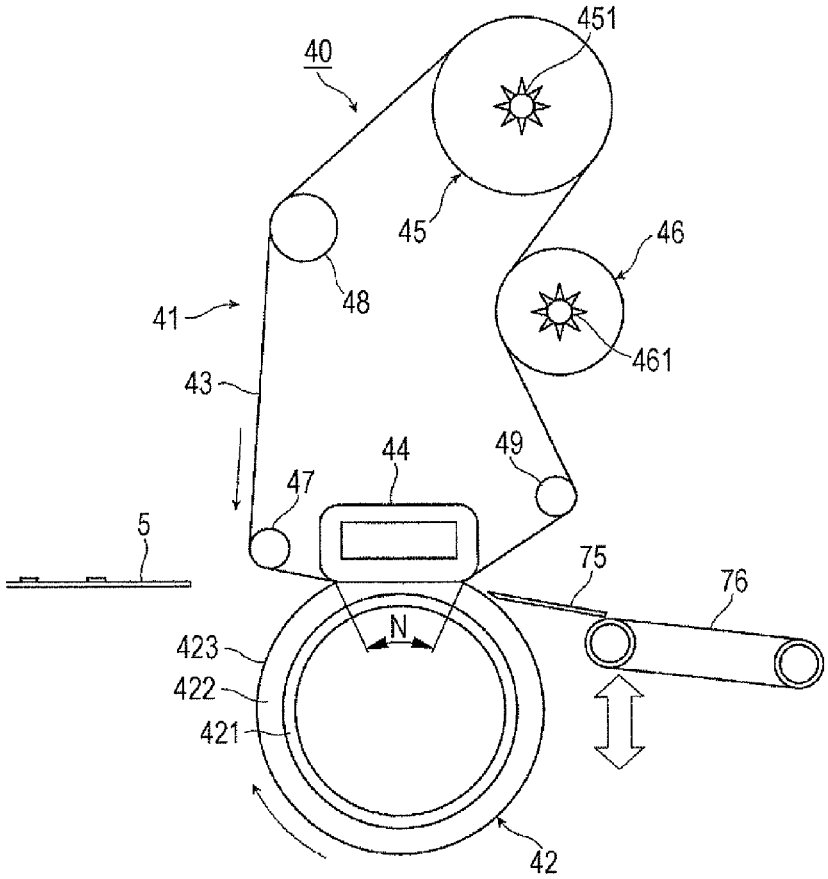
FIG. 3 is a perspective view of the fixing device.

FIG. 3 shows the configuration of the fixing device according to the first exemplary embodiment.

The fixing device 40 is roughly composed of a fixing belt module 41 and a pressurizing roller 42. The fixing belt module 41 serves as a heating rotary member that heats the recording paper 5. The pressurizing roller 42 serves as a pressurizing rotary member disposed selectively in contact with or away from the fixing belt module 41. A nip part N is formed between the fixing belt module 41 and the pressurizing roller 42. The nip part N serves as a fixation processing part at which the recording paper 5 holding unfixed toner images is heated and pressurized to fix the unfixed toner images to the recording paper 5.

The fixing belt module 41 includes a fixing belt 43, a fixing pad 44, and plural support rollers 45 to 49. The fixing belt 43 serves as an example of a belt member formed as an endless belt. The secured pad 44 serves as an example of a secured member disposed in a secured state in contact with the inner peripheral surface of the fixing belt 43 to bring the fixing belt 43 into press contact with the pressurizing roller 42 from the inner side. The support rollers 45 to 49 rotatably support the fixing belt 43 in a tensioned state. In the exemplary embodiment, some of the plural support rollers 45 to 49 also serve as heating rollers that serve as a heating unit that heats the fixing belt 43.

The plural support rollers 45 to 49 include an internal heating roller 45, an external heating roller 46, a first driven roller (pre-nip roller) 47, a second driven roller 48, and a third driven roller 48. The internal heating roller 45 heats the fixing belt 43 from the inner side with the fixing belt 43 in a tensioned state. The external heating roller 46 heats the fixing belt 43 from the outer side with the fixing belt 43 in a tensioned state. The first driven roller 47 is disposed upstream of the nip part of the secured pad 44 to hold the fixing belt 43 in a desired state. The second driven roller 48 is disposed between the first driven roller 47 and the internal heating roller 45 to hold the fixing belt 43 in a desired state. The third driven roller 49 is disposed between the secured pad 44 and the external heating roller 46 to hold the fixing belt 43 having passed through the nip part N in a desired state.

Figure 4:
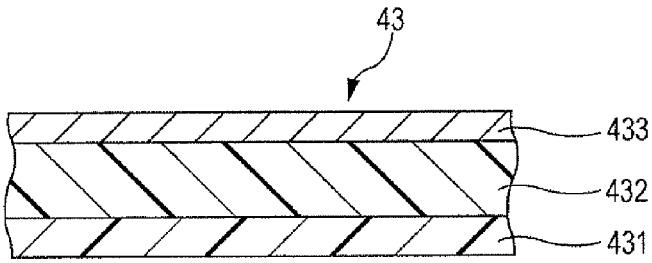
FIG. 4 is a cross-sectional view showing the configuration of a fixing belt.

As shown in FIG. 4, the fixing belt 43 is a flexible endless belt, and includes a base layer 431, an elastic member layer 432, and a release layer 433, for example. The base layer 431 is formed from a polyimide resin. The elastic member layer 432 is formed from a silicone rubber laminated on a surface (outer peripheral surface) of the base layer 431. The release layer 433 is formed from a tetrafluoroethylene-perfluoroalkyl vinyl ether copolymer (PFA) applied to a surface of the elastic member layer 432. The configuration of the fixing belt 43, such as material, thickness, and hardness, may be selected appropriately in accordance with conditions required for the fixing device 40 such as purpose of use and conditions of use. In the exemplary embodiment, the elastic member layer 432 is provided on the surface of the base layer 431 for the purpose of improving the image quality of the color image. The recording paper 5 on which powder toners in various colors are superposed passes through the nip part N which serves as a press contact region in which the fixing belt module 41 and the pressurizing roller 42 are in press contact with each other. Therefore, the elastic member layer 432 of the fixing belt 43 is deformed in accordance with the toner images on the recording paper 5, which makes it possible to supply heat to the entire toner images.

The internal heating roller 45 which serves as an example of the heating unit is a cylindrical roller formed from aluminum or stainless steel, for example. One or more halogen heaters 451 that serve as an example of a heating source are disposed inside the internal heating roller 45 to heat the surface of the internal heating roller 45 to a predefined temperature (for example, 190° C.). The internal heating roller 45 is provided with a meandering controller (not shown) that serves as a meandering control unit that controls meandering of the fixing belt 43. The meandering controller includes a detection unit (end portion sensor) (not shown) that detects the position of an end portion of the fixing belt 43 along the width direction. One end portion of the internal heating roller 45 along the axial direction is moved in the direction perpendicular to the axial direction on the basis of information on the position of the end portion of the fixing belt 43 detected by the detection unit to control meandering of the fixing belt 43.

The external heating roller 46 which serves as an example of the heating unit is a cylindrical roller formed from aluminum or stainless steel, for example. A release layer made of a fluorine resin is formed on the surface of the external heating roller 46. One or more halogen heaters 461 are disposed inside the external heating roller 46 as an example of a heating source to heat the surface of the external heating roller 46 to a predefined temperature (for example, 190° C.). Spring members (not shown) are disposed at both end portions of the external heating roller 46 along the axial direction to press the fixing belt 43 inward to apply a tension of 15 kgf, for example, to the entire fixing belt 43.

In the exemplary embodiment, the fixing belt 43 is heated by the internal heating roller 45 and the external heating roller 46. However, the present invention is not limited thereto, and a heating source may be disposed inside the secured pad 44 so that the secured pad 44 heats the fixing belt 43 in addition to the internal heating roller 45 and the external heating roller 46.

Thus, the fixing belt 43 is a member formed as an endless belt, and has a low heat capacity compared to a fixing member formed as a roll. Thus, the surface of the fixing belt 43 is heated to a predefined temperature while the fixing belt 43 passes through the internal heating roller 45 and the external heating roller 46. In addition, the internal heating roller 45 and the external heating roller 46 are disposed to contact the fixing belt 43 over a large area.

The pressurizing roller 42 is composed of a substrate 421, an elastic member layer 422, and a release layer 423. The substrate 421 is a cylindrical or columnar roller made of aluminum or stainless steel, for example. The elastic member layer 422 is made of a silicone rubber, and is applied to the outer peripheral surface of the substrate 421. The release layer 423 is made of a PFA tube, and is applied to the surface of the elastic member layer 422. The pressurizing roller 42 is disposed to be movable into contact with and away from the fixing belt module 41 through a movement unit (not shown), and rotationally driven along the direction of the arrow by a drive unit (not shown). The fixing belt 43 is driven for rotation in the direction of the arrow along with rotation of the pressurizing roller 42 with the pressurizing roller 42 in press contact with the fixing belt 43 at the nip part N.

The secured pad 44, which serves as an example of a secured member, is a member made of a rigid material such as aluminum, stainless steel, or a synthetic resin, for example, and formed to have a generally rectangular cylindrical or generally rectangular columnar cross-sectional shape. The secured pad 44 is disposed on the inner peripheral side of the fixing belt 43 with both end portions secured to a frame (not shown) of the fixing device 40 so that the secured pad 44 extends over the entire length of the pressurizing roller 42 along the axial direction, for example. The secured pad 44 is disposed to uniformly press the pressurizing roller 42 via the fixing belt 43 over a predefined width region (for example, 10 to 50 mm) with a predefined load (for example, 3.0 to 6.0 $kgf/cm^2$). The secured pad 44 thus forms the nip part N in press contact with the pressurizing roller 42 via the fixing belt 43.

Figure 5:
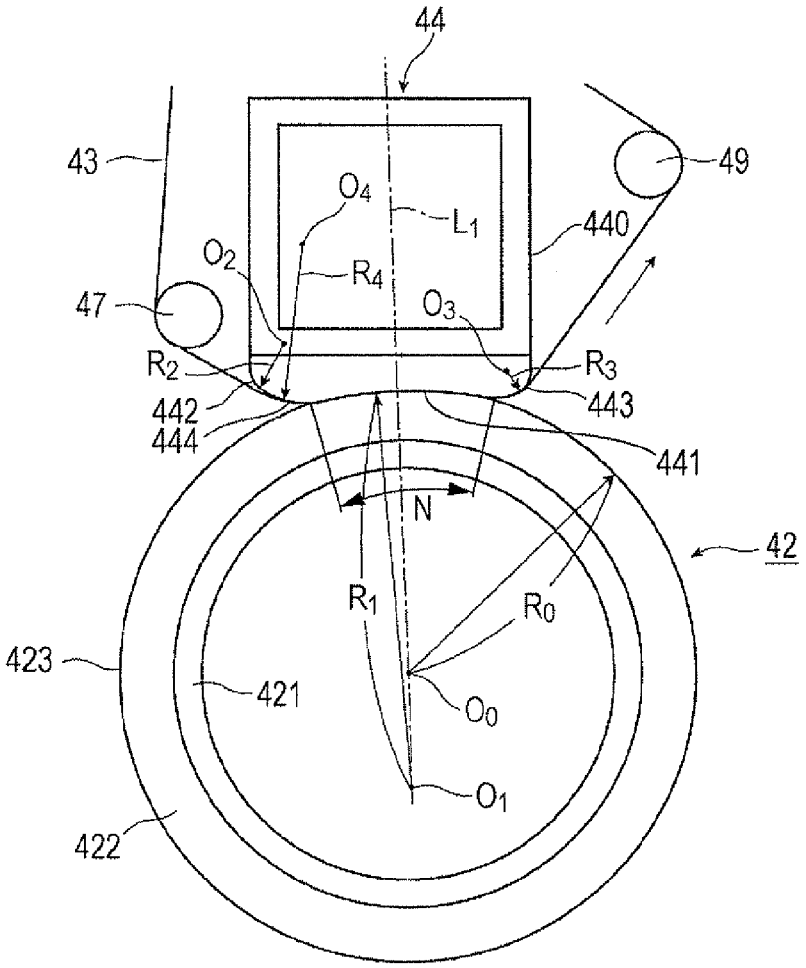
FIG. 5 shows the configuration of a portion of the fixing device.
Figure 6:
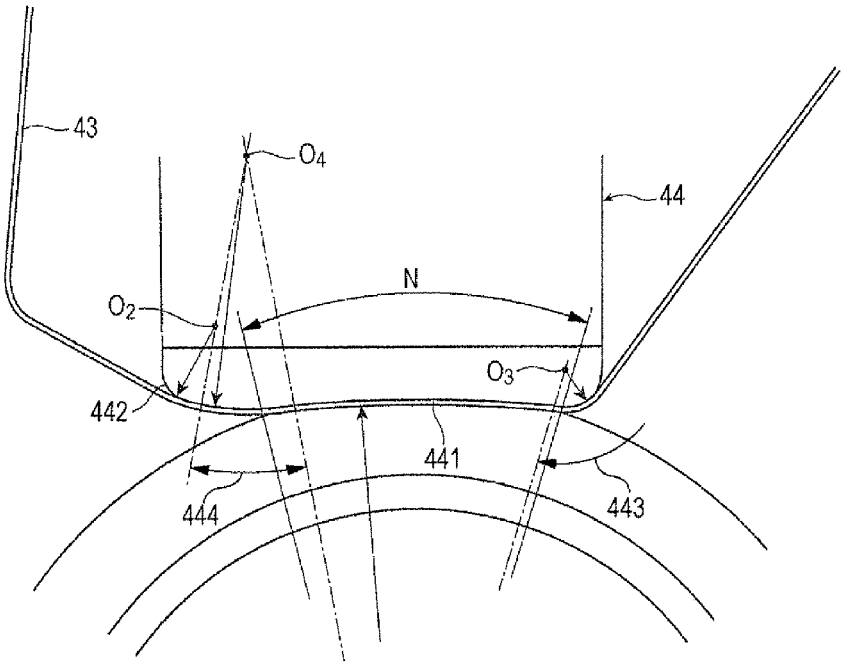
FIG. 6 is an enlarged view showing the configuration of a portion of the fixing device.

As shown in FIG. 5, the secured pad 44 includes a pressing part 441, which serves as an example of a recessed part, disposed in a surface of the secured pad 44 that faces the pressurizing roller 42 to press the fixing belt 43 against the pressurizing roller 42. The pressing part 441 is configured to curve the fixing belt 43 on the pressurizing roller 42 side into a recessed shape (arcuate shape) in which the fixing belt 43 is recessed from the pressurizing roller 42 toward the secured pad 44. For further description, the pressing part 441 is formed by recessing the surface of the secured pad 44 into a recessed (arcuate) shape with the center $O_1$ of the circle disposed on the side of the pressurizing roller 42 facing the secured pad 44. The radius of curvature $R_1$ of the pressing part 441 is set to be larger than the radius $R_0$ of the pressurizing roller 42, for example. Bringing the pressurizing roller 42 into press contact with the secured pad 44 elastically deforms the elastic member layer 422 of the pressurizing roller 42 in accordance with the cross-sectional shape of the pressing part 441. This makes it possible to form the nip part N that is wide along the circumferential direction on the outer peripheral surface of the pressurizing roller 42 compared to a case where a fixing member formed as a roll is brought into press contact with the secured pad 44.

The secured pad 44 also includes an input-side guiding part 442 and an output-side guiding part 443. The input-side guiding part 442 serves as an example of a projecting part provided upstream (on the input side) of the pressing part 441 along the moving direction of the fixing belt 43 (travel direction of the recording material). The output-side guiding part 443 serves as an example of a projecting part provided downstream (on the output side) of the pressing part 441 along the moving direction of the fixing belt 43. The input-side guiding part 442 and the output-side guiding part 443 are formed to curve the fixing belt 43 on the pressurizing roller 42 side into a projected (arcuate) shape in which the fixing belt 43 is projected from the secured pad 44 toward the pressurizing roller 42. For further description, the input-side guiding part 442 projects toward the pressurizing roller 42 in an arcuate shape with the center $O_2$ of the circle disposed on the side of the secured pad 44 facing the pressurizing roller 42. Meanwhile, the output-side guiding part 443 projects toward the pressurizing roller 42 in an arcuate shape with the center $O_3$ of the circle disposed on the side of the secured pad 44 facing the pressurizing roller 42. The respective radii of curvature $R_2$ and $R_3$ of the input-side guiding part 442 and the output-side guiding part 443 are set to be greatly smaller than the radius of curvature $R_1$ of the pressing part 441. The respective radii of curvature of the input-side guiding part 442 and the output-side guiding part 443 may be set to be equal to each other, for example. In the exemplary embodiment, however, the radius of curvature $R_3$ of the downstream guiding part 443 is set to be smaller than the radius of curvature $R_2$ of the upstream guiding part 442 ($R_3<R_2$) so that the fixing belt 42 is curved with a larger curvature on the downstream side in consideration of the detachability of the recording paper 5.

The secured pad 44 further includes a second guiding part 444 provided on the input side between the input-side guiding part 442 and the pressing part 441. The second guiding part 444 is a region having a small curvature (large radius of curvature) compared to the input-side guiding part 442. For further description, the input-side guiding part 442 includes the second guiding part 444 provided on the pressing part 441 side. The radius of curvature $R_4$ of the second guiding part 444 is set to be larger than that of the input-side guiding part 442. The second guiding part 444 is shaped to project toward the pressurizing roller 42 in an arcuate shape with the center $O_4$ of the circle disposed on the side of the secured pad 44 facing the pressurizing roller 42.

The input-side guiding part 442 and the second guiding part 444 are connected to be smoothly continuous. That is, the input-side guiding part 442 and the second guiding part 444 are formed such that the respective tangents to the input-side guiding part 442 and the second guiding part 444 at a connection portion at which the input-side guiding part 442 and the second guiding part 444 are connected extend in the same direction, for example. For further description, the input-side guiding part 442 and the second guiding part 444 are connected on a straight line that connects between the center $O_2$ of the arc forming the input-side guiding part 442 and the center $O_4$ of the arc forming the second guiding part 444.

Similarly, the second guiding part 444 and the pressing part 441, and the pressing part 441 and the output-side guiding part 443, are connected to be smoothly continuous. The second guiding part 444 and the pressing part 441 are connected on a straight line that connects between the center $O_4$ of the arc forming the second guiding part 443 and the center $O_1$ of the arc forming the pressing part 441. Meanwhile, the pressing part 441 and the output-side guiding part 443 are connected on a straight line that connects between the center $O_1$ of the arc forming the pressing part 441 and the center $O_3$ of the arc forming the output-side guiding part 443. The nip part N is formed from the pressing part 441 of the secured pad 44. However, the nip part N may be formed to include a part of the second guiding part 444 and a part of the output-side guiding part 443.

The fixing device 40 may include a low-sliding-resistance member 440 in the form of a sheet interposed between the secured pad 44 and the fixing belt 43 to reduce the sliding resistance therebetween.

<Operation of Fixing Device>

In the image forming apparatus 1, as shown in FIG. 1, a toner image is electrostatically transferred from the intermediate transfer belt 21 onto the recording paper 5 through the second transfer performed at the second transfer position, and the recording paper 5 to which an unfixed toner image has been transferred is transported to the fixing device 40. In the fixing device 40, as shown in FIG. 3, the unfixed toner image is fixed onto the recording paper 5 with the recording paper 5 heated and pressurized while the recording paper 5 passes through the nip part N formed between the fixing belt module 41 and the pressurizing roller 42.

In the fixing device 40 according to the exemplary embodiment, the recording paper 5 which passes through the nip part N is heated by the fixing belt 43. The fixing belt 43 is heated by the internal heating roller 45 which contacts the inner peripheral surface of the fixing belt 43 and the external heating roller 46 which contacts the outer peripheral surface of the fixing belt 43.

In the fixing device 40, the secured pad 44 is a rigid member formed from aluminum, stainless steel, or the like, and the pressurizing roller 42 is a soft roller coated with the elastic member layer 423. Therefore, the nip part N which has some width in the moving direction of the fixing belt 43 is formed with the secured pad 44 hardly warped but with the elastic member layer 422 positioned on the surface of the pressurizing roller 42 warped.

On the output side of the nip part N of the secured pad 44, as shown in FIG. 5, the fixing belt 43 is transported along the output-side guiding part 443 disposed on the output side of the secured pad 44. Thus, the transport direction of the fixing belt 43 is abruptly changed there. That is, the fixing belt 43 moves along the output-side guiding part 443 of the secured pad 44, and therefore the curvature of the fixing belt 43 becomes large enough to match the radius of curvature $R_3$ of the output-side guiding part 443. This allows the recording paper 5, the adhesion of which to the fixing belt 43 has been reduced in the nip part N, to be separated from the fixing belt 43 by the firmness (rigidity) of the paper itself.

The recording paper 5 separated from the fixing belt 43 is transported toward the cooling unit 70 by a paper ejection guiding plate 75 and a paper ejecting belt 76 disposed downstream of the secured pad 44. The fixing device 40 thus finishes the fixation process.

When the fixing belt 43 moves to the nip part N through the first driven roller 47, as shown in FIG. 5, the fixing belt 43 contacts the input-side guiding part 442 provided upstream of the nip part N of the secured pad 44 to be curved into a shape in which the fixing belt 43 is projected downward from the secured pad 44 toward the pressurizing roller 42 at the curvature of the input-side guiding part 442 of the secured pad 44. After that, at the pressing part 441 of the secured pad 44 forming the nip part N, the travel direction of the fixing belt 43 is changed by the pressurizing roller 42 such that the fixing belt 43 is recessed toward the secured pad 44 (projected upward) at the curvature in the opposite direction. Further, the fixing belt 43, which has been curved to be projected upward at the curvature of the pressurizing roller 42 at the pressing part 441 of the secured pad 44, contacts the output-side guiding part 443 provided downstream of the pressing part 441 of the secured pad 44 to be curved again into a shape in which the fixing belt 43 is projected toward the pressurizing roller 42 (downward) at the curvature of the output-side guiding part 443 of the secured pad 43.

Thus, when the fixing belt 43 passes through the nip part N, the fixing belt 43 is curved into a downwardly projected shape, then deformed into a shape in which the fixing belt 43 is recessed toward the secured pad 44 (upwardly projected shape), and thereafter curved into a downwardly projected shape again in accordance with the shape of the input-side guiding part 442, the pressing part 441, and the output-side guiding part 443, respectively, formed on the surface of the secured pad 44 on the pressurizing roller 42 side. That is, the travel direction of the fixing belt 43 is changed with curvatures in opposite directions from a projected shape to a recessed shape and then from a recessed shape to a projected shape again.

Moreover, the guiding parts 442 and 443 positioned on the input side and the output side, respectively, of the nip part N change the moving direction of the fixing belt 43 from the first driven roller 47 to the third driven roller 49. In particular, the curvature of the output-side guiding part 443 is set to be large compared to the nip part N (the radii of curvature $R_2$ and $R_3$ are set to be small) in order to separate the recording paper 5 from the fixing belt 43.

In the exemplary embodiment, as shown in FIG. 5, the second guiding part 444 is provided on the input side in a region between the input-side guiding part 442 and the pressing part 441. The second guiding part 444 has a small curvature (large radius of curvature) compared to the input-side guiding part 442. In this way, when the fixing belt 43 moves from the input-side guiding part 442 to the pressing part 441, the fixing belt 43 moves from the input-side guiding part 442 to the pressing part 441 via the second guiding part 444. As a result, the fixing belt 43 reaches the pressing part 441 from the input-side guiding part 442 with its curvature reduced (with its radius of curvature increased) via the second guiding part 444.

For further description, when the fixing belt 43 moves from the input-side guiding part 442 to the pressing part 441, the curvature of the fixing belt 43 is not immediately changed from the curvature of the input-side guiding part 441 to the curvature of the pressing part 441, but changed to the curvature of the pressing part 441 via the curvature of the second guiding part 444, which is provided on the pressing part 441 side with respect to the input-side guiding part 442. The curvature of the second guiding part 444 is set to be smaller than the curvature of the input-side guiding part 441. Therefore, after the curvature of the fixing belt 43 is reduced as the fixing belt 43 moves from the input-side guiding part 441 toward the pressing part 441, the curvature of the fixing belt 43 is inverted to reach the curvature of the pressing part 441.

Therefore, the curvature of the fixing belt 43 is not abruptly inverted from the curvature of the input-side guiding part 442 to the curvature of the pressing part 441 when the fixing belt 43 moves from the input-side guiding part 442 to the pressing part 441.

Second Exemplary Embodiment

Figure 7:
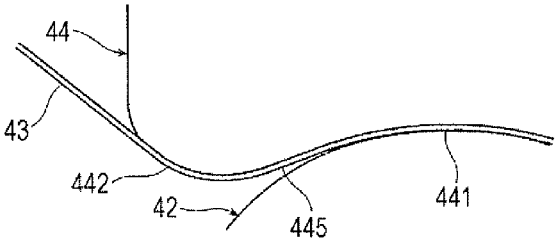
FIG. 7 shows a schematic configuration of a portion of a fixing device according to a second exemplary embodiment of the present invention.

FIG. 7 is a cross-sectional view showing the configuration of a fixing device according to a second exemplary embodiment of the present invention.

In the fixing device 40 according to the second exemplary embodiment, as shown in FIG. 7, a straight portion 445 formed to be straight is provided between the input-side guiding part 442, which is provided upstream of the pressing part 441, and the pressing part 441. The input-side guiding part 442 and the pressing part 441 are connected to be smoothly continuous by the straight portion.

Providing the straight portion 445 between the input-side guiding part 442 and the pressing part 441 makes the fixing belt 43 planar along the straight portion 445 when the fixing belt 43 moves to the nip part N.

The configuration and the operation are otherwise similar to those of the first exemplary embodiment described earlier. Thus, such similarities are not described.

Third Exemplary Embodiment

Figure 8:
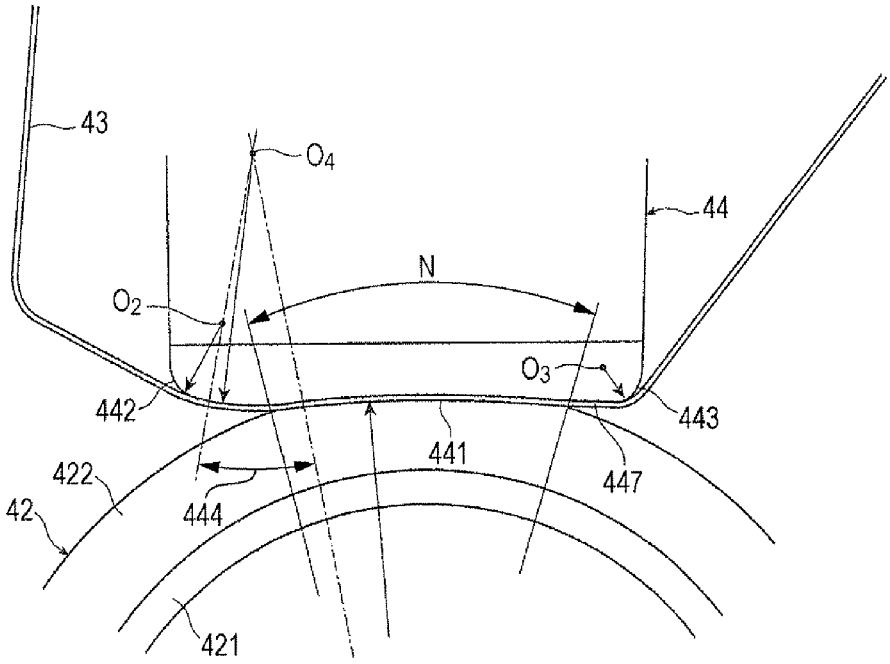
FIG. 8 shows a schematic configuration of a portion of a fixing device according to a third exemplary embodiment of the present invention.

In the fixing device 40 according to a third exemplary embodiment, as shown in FIG. 8, a straight portion 447 formed to be straight is provided between the output-side guiding part 443, which is provided downstream of the pressing part 441, and the pressing part 441. The output-side guiding part 443 and the pressing part 441 are connected to be smoothly continuous by the straight portion.

The configuration and the operation are otherwise similar to those of the first exemplary embodiment described earlier. Thus, such similarities are not described.

Fourth Exemplary Embodiment

Figure 9:
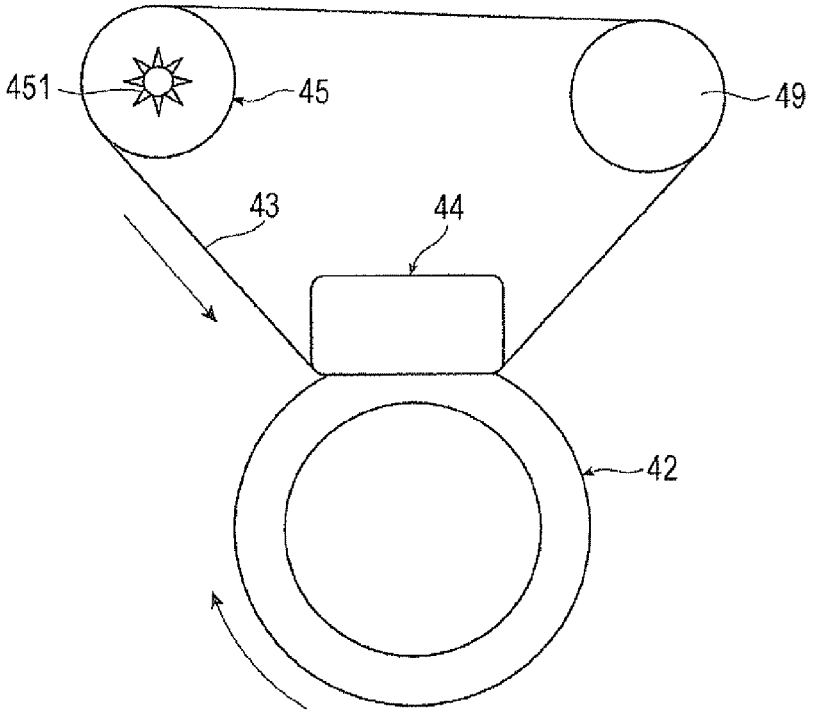
FIG. 9 shows a schematic configuration of a portion of a fixing device according to a fourth exemplary embodiment of the present invention.

In the fixing device 40 according to a fourth exemplary embodiment, as shown in FIG. 9, two rollers, namely the internal heating roller 45 and a support roller 49 for meandering control, are used as support rollers that apply a tension to the fixing belt 43.

In the case of the fixing device 40, the entire device may be reduced in size, contributing to a reduction in size of the image forming apparatus 1. In order to supply a sufficient amount of heat to the fixing belt 43, the secured pad 44 may be provided with a heating source.

The configuration and the operation are otherwise similar to those of the first exemplary embodiment described earlier. Thus, such similarities are not described.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

an endless belt member;

a secured member disposed in a secured state to contact an inner peripheral surface of the belt member;

a support roller that rotatably supports the belt member;

a heating unit that heats the belt member; and a rotary pressurizing roller that includes an elastic surface layer that is elastically deformed when the belt member is pressed against the secured member to form a fixing part, wherein the secured member includes a recessed part provided on a surface of the secured member that faces the pressurizing roller and configured to curve the belt member along the secured member into a recessed shape in which the belt member is recessed from the pressurizing roller toward the secured member, projecting parts provided upstream and downstream of the recessed part, respectively, along a moving direction of the belt member and configured to curve the belt member into a projected shape in which the belt member is projected toward the pressurizing roller, and a region provided between (i) at least one of the projecting parts provided upstream and downstream of the recessed part and (ii) the recessed part, the region having a small curvature compared to the corresponding projecting part.

2. The fixing device according to claim 1, wherein the region having a small curvature compared to the projecting part is provided between (i) the projecting part provided upstream of the recessed part and (ii) the recessed part.

3. The fixing device according to claim 1, wherein the region having a small curvature compared to the projecting part is provided between (i) the projecting part provided upstream of the recessed part and (ii) the recessed part, the curvature of the region becoming smaller toward the recessed part.

4. The fixing device according to claim 1, wherein a straight portion formed to be straight is provided between (i) the projecting part provided upstream of the recessed part and (ii) the recessed part.

5. The fixing device according to claim 1, wherein a straight portion formed to be straight is provided between (i) the projecting part provided downstream of the recessed part and (ii) the recessed part.

6. An image forming apparatus comprising:

an image forming unit that forms an image on a recording material; and a fixing unit that fixes the image formed on the recording material by the image forming unit to the recording material, the fixing unit being the fixing device according to claim 1.

* * * * *